United States Patent [19]

Donner

[11] Patent Number: 4,539,779

[45] Date of Patent: Sep. 10, 1985

[54] METHOD OF COMPENSATING FOR DRESSING TOOL WEAR DURING THE DRESSING OF GRINDING WHEELS

[75] Inventor: Meinrad Donner, Nuolen, Switzerland

[73] Assignee: Maag Gear-Wheel & Machine Company Limited, Zürich, Switzerland

[21] Appl. No.: 472,652

[22] Filed: Mar. 7, 1983

[30] Foreign Application Priority Data

Mar. 19, 1982 [CH] Switzerland ..... 1706/82

[51] Int. Cl.[3] ..... B24B 1/00

[52] U.S. Cl. ..... 51/325; 51/165.88; 125/11 AS; 125/11 DF

[58] Field of Search ..... 51/165.77, 165.88, 165.89, 51/165.71, 325; 125/11 AS, 11 DF

[56] References Cited

U.S. PATENT DOCUMENTS

| | | | |
|---|---|---|---|
| 4,045,920 | 9/1977 | Fukuma | 51/165.88 |
| 4,143,637 | 3/1979 | Mesey | 51/165.87 |
| 4,213,277 | 7/1980 | Fivian | 51/165.88 |
| 4,391,066 | 7/1983 | Munckata | 51/165.87 |
| 4,420,910 | 12/1983 | Lorsson | 51/165.88 |
| 4,423,970 | 1/1984 | Bartosek | 51/165.88 |

FOREIGN PATENT DOCUMENTS 2726843 11/1978 Fed. Rep. of Germany .

*Primary Examiner*—Harold D. Whitehead
*Attorney, Agent, or Firm*—Werner W. Kleeman

[57] ABSTRACT

The dressing tool is mounted on a cross-slide so as to be displaceable in parallel and normally with respect to the working surface or face of the grinding wheel which is to be dressed. After each dressing operation the grinding wheel is re-adjusted so as to be repositioned in a defined plane. A displacement measuring system is operatively coupled to the grinding wheel in order to measure the amount of such re-adjustment or adjustment. A difference observed between the desired amount of dressing and the measured amount of adjustment indicates the extent of wear of the dressing tool. The dressing tool is then correspondingly further adjusted and the grinding wheel is subjected to a further dressing operation.

4 Claims, 1 Drawing Figure

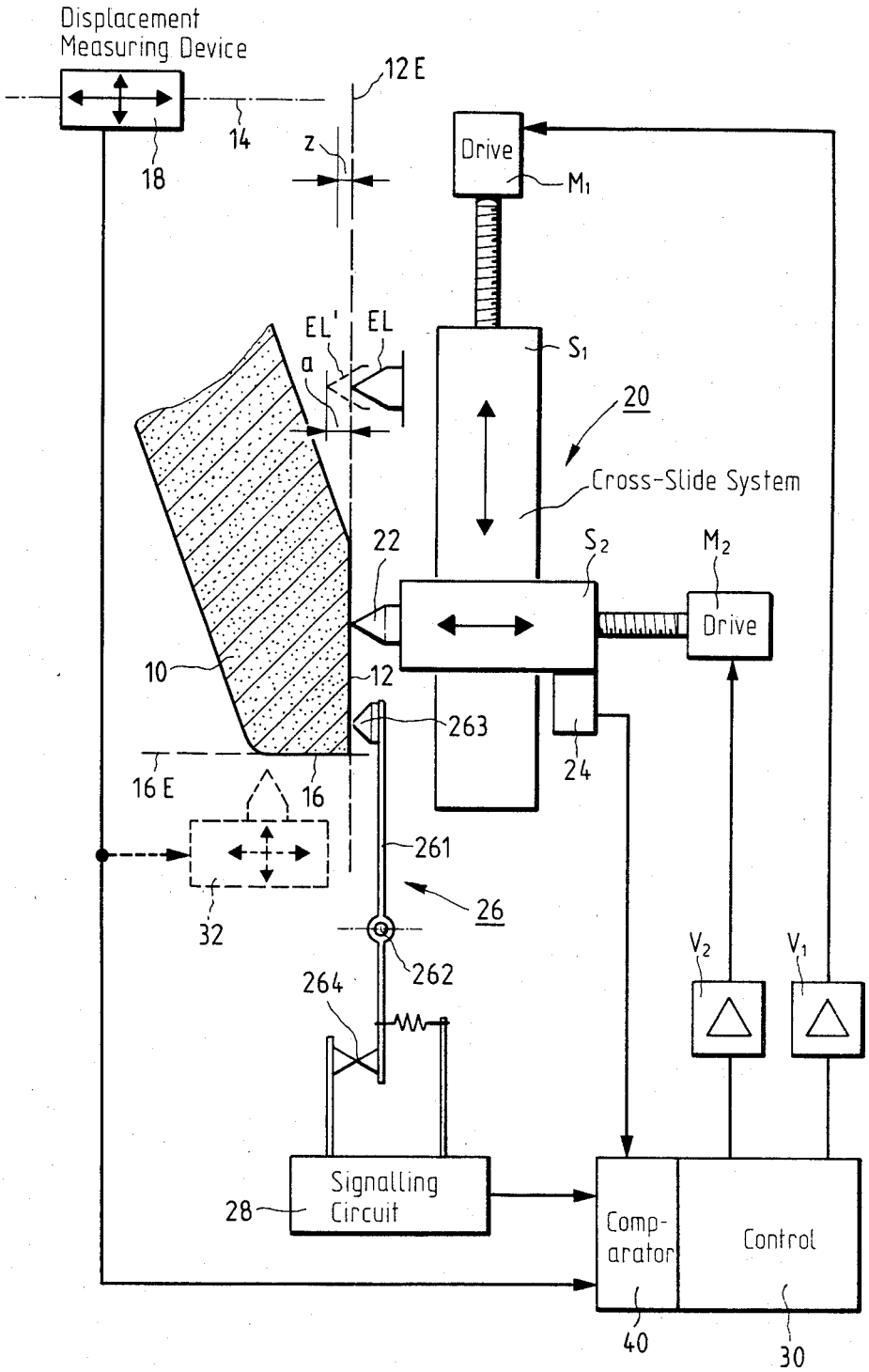
Displacement
Measuring Device
12 E
14
18
z
Drive
M1
EL'
EL
a
S1
20
Cross-Slide System
22
S2
M2
Drive
10
12
263
24
16 E
16
261
26
32
262
264
V2
V1
Signalling
Circuit
28
Comp-
arator
Control
40
30

METHOD OF COMPENSATING FOR DRESSING TOOL WEAR DURING THE DRESSING OF GRINDING WHEELS

BACKGROUND OF THE INVENTION

The present invention relates to a new and improved method of compensating for the wear of an adjustable or advanceable dressing tool for grinding wheels, by means of which a working or active surface of the grinding wheel, which is positioned in a defined plane, is dressed by an adjustable dressing amount.

In a known method of, and apparatus for, dressing a grinding wheel as disclosed, for example, in U.S. Pat. No. 4,213,277, granted July 22, 1980, an axially adjustable dished grinding wheel of a gear wheel grinding machine acts upon a workpiece by means of a working surface or face which is dressed in intervals. During the dressing operation the position of the working or active surface of the grinding wheel is controlled and the grinding wheel is re-adjusted such that the working surface thereof remains in the same position independent of the degree of wear. The dressing tool is also axially adjustable and the working surface of the grinding wheel is dressed once during a preselected dressing interval. The dressing tool is always axially adjusted in case that a preselected total amount of grinding wheel re-adjustment is not reached within the dressing interval. The dressing operation has the purpose of obtaining and maintaining a high cutting efficiency of the highly-loaded grinding wheels during the grinding of gears. The working surface or face of the grinding wheel always has to be dressed sufficiently in order to remain sharp. For controlling the position of the working surface or face of the grinding wheel in intervals a sensor is intermittently pivoted to engage such working surface or face. A contact is operatively associated with the sensor and when the contact is closed due to a certain amount of wear of the working surface then the grinding wheel is axially re-adjusted. The dressing interval has a length or time frame which depends upon the nature of the grinding wheel and which may be selected according to the amount of material which has to be removed from the gear wheel. If a certain number of re-adjustments of the grinding wheel are not reached within a dressing interval, this means that the working surface or face is not sufficiently sharp and will have to be dressed anew. Depending upon the extent by which the number of grinding wheel re-adjustments is less than the preselected number of re-adjustments, then the dressing tool is adjusted or advanced to a greater or lesser extent for the dressing of the working surface or face. Thereafter the grinding operation is resumed for the duration of the next following dressing interval and the operation as described hereinbefore is repeated during this dressing interval.

When using the known method it can thus first only be determined after expiration of the dressing interval whether the grinding wheel is sharp and works correctly. This can be disadvantageous for heavily used grinding wheels because the grinding operation is then accomplished for a certain amount of time with an insufficiently sharp working or active surface or face. The shortfall in the number of grinding wheel re-adjustments during the preceding dressing interval only permits an indirect conclusion with respect to the degree of wear of the dressing tool, because it is simply assumed that the dressinng tool was insufficiently effective. during the preceding dressing operation due to wear thereof, so that it has to be correspondingly adjusted during the following dressing operations. The success of the dressing operation after re-adjustment again only can be detected after expiration of the subsequent dressing interval. In the prior art method the degree or extent of wear of the dressing tool cannot be measured and the adjustment thereof only can be accomplished in steps, so that improvements are required as concerns the compensation for the wear of the dressing tool.

SUMMARY OF THE INVENTION

Therefore, with the foregoing in mind it is a primary object of the present invention to provide a new and improved method of compensating for the wear of an axially adjustable dressing tool for dressing the working or active surface or face of an axially adjustable grinding wheel, which permits immediate determination of the degree of wear of the dressing tool, i.e. prior to the start of the next dressing interval.

Another important object of the present invention is directed to the provision of a new and improved method of compensating for the wear of an axially adjustable dressing tool for dressing a working surface or face of a grinding wheel, wherein the degree of wear of the dressing tool can be determined immediately, i.e. prior to the start of the next dressing operation, with a high degree of precision.

Still another significant object of the present invention is directed to the provision of a new and improved method of compensating for the wear of an axially adjustable dressing tool for dressing a working surface or face of a grinding wheel, by means of which the dressing tool can be precisely adjusted.

Now in order to implement these and still further objects of the invention, which will become more readily apparent as the description proceeds, the method of the present development is manifested by the features that, the grinding wheel is positioned so that the working surface or face thereof extends in the defined plane, the tip of the dressing tool is positioned in an end position displaced from the working surface but within the defined plane, the dressing tool is advanced or adjusted by a desired dressing amount, the working surface of the grinding wheel is dressed accordingly, the grinding wheel is advanced or adjusted to position the dressed working surface thereof in the aforementioned defined plane, and at the same time there is measured the amount of adjustment or advance of the grinding wheel and such is compared with the desired dressing amount, and if there is determined a difference between these two amounts then the tip of the dressing tool is again positioned in the end position and adjusted by an amount increased by the difference between the desired dressing amount and the amount of grinding wheel adjustment, following which the dressing operation is repeated.

The apparatus of the present development is manifested by the features that, the grinding wheel is adjustable so that the working surface or face thereof is located in the defined plane, a displacement measuring system is operatively coupled to the grinding wheel, and a sensing device or feeler is arranged to sense the presence of the working surface in the defined plane. There is provided a cross-slide system having a first and a second slide which accommodates the dressing tool, drive means serve for infinitely displacing each of the slides, one essentially in parallel and the other one essentially normally with respect to the working surface of the grinding wheel. There is also provided control means acted upon by the sensing device and operatively coupled to the displacement measuring system. The control means evaluates displacement data supplied thereto by the displacement measuring system and controls the adjustment or advance of the slide which displaces the dressing tool normally to the working surface of the grinding wheel in accordance with the difference between the displacement of the grinding wheel into the defined plane and the desired amount of dressing.

In the method according to the invention the dressing tool is advanced or adjusted by a desired dressing amount. After dressing the working surface or face of the grinding wheel the latter is immediately advanced or adjusted in order to place the working surface thereof again in the defined plane. In case that the amount of the advance or adjustment of the grinding wheel equals the desired amount of dressing then the dressing tool is not worn and the working surface or face of the grinding wheel has been dressed sufficiently, i.e. has been sharpened sufficiently, so that the grinding operation can be started immediately. However, in the event a difference is detected between the amount of the grinding wheel advance or adjustment and the desired amount of dressing, then the dressing tool is re-adjusted in correspondence to this difference and in addition to the desired amount of dressing which has not been obtained, and then the dressing operation is resumed. The working surface or face of the grinding wheel obtained after the further dressing operation will then have the desired sharpness and the grinding operation may be started. In this way wear of the dressing tool is recognized immediately and the dressing tool may be continuously adjusted or advanced in accordance with its extent or degree of wear. Consequently, there is dispensed with the need to wait for the end of the following dressing interval which was heretofore required with the prior art dressing method. Also, there is eliminated the stepwise adjustment or advance due to an indirect conclusion as to the degree of wear of the dressing tool as needed with the prior art method, since the inventive method continuously adjusts the dressing tool on the basis of a precise measurement. Thus, with the method and apparatus according to the invention, the wear of the dressing tool can be compensated substantially more rapidly and more precisely, whereby the grinding efficiency of the grinding wheel is substantially improved.

Although, preferably, the method according to the invention is also carried out in intervals, it nonetheless, however, offers the additional advantage that the degree or extent of wear of the dressing tool detected during each dressing operation can be stored, so that an averaged or meaned value of the dressing tool wear can be determined from a number of dressing operations. By using such averaged or meaned value of dressing tool wear the desired amount of dressing can be immediately adjusted or set for the subsequent dressing operations in which, then, the working surface or face will be sufficiently sharpened in one dressing operation, i.e. there will be obtained an equality between the desired amount of dressing and the amount of axial grinding wheel adjustment or advance in one dressing operation.

As previously explained, the apparatus for carrying out the method according to the invention comprises a cross-slide system upon which the dressing tool is mounted. The slide of the cross-slide system which is displaceable perpendicular or normally with respect to the working surface or face of the grinding wheel is infinitely displaceable, so that the dressing tool can be axially adjusted substantially more precisely, i.e. exactly in accordance with the degree of wear thereof. While in the prior art apparatus the dressing tool is only axially adjustable or advanceable and pivotally movable across the working surface or face for performing the dressing operation, according to the inventive apparatus the dressing tool can be displaced in parallel and at right angles with respect to the working surface of the grinding wheel. This enables the apparatus to be used not only for dressing the annular or ring-shaped working surface or face i.e. the active rim or surface of a dished grinding wheel, but also an apparatus of the same type can be additionally used for dressing the outer surface of the same grinding wheel. The displacement measuring system can be used for measuring the amount of grinding wheel adjustment or advance after the dressing operation, which displacement measuring system is arranged on the grinding wheel axis and can measure the grinding wheel adjustment or advance both in axial and in radial direction.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE schematically depicts an apparatus for carrying out the method according to the invention.

DETAILED DESCRIPTION OF THE PREFERRED EMBODIMENTS

Describing now the drawing, it is to be understood that only enough of the construction of the exemplary embodiment of apparatus has been shown as needed for those skilled in the art to readily understand the underlying principles and concepts of the present development, while simplifying the showing of the drawing. Turning attention now to the single FIGURE of the drawing, there has been shown as an example of a grinding wheel to be dressed a dished grinding wheel 10 including a substantially flat or planar working surface or face 12 for machining the tooth flanks of a conventional gear wheel (not shown). The grinding wheel 10 is mounted upon a grinding spindle which has been generally indicated by the central axis 14 thereof. The grinding spindle is journaled and guided in such a way that the grinding wheel 10 may be axially and radially displaced with respect to the central axis 14 by any suitable adjusting or adjustment drive means. Prior to a grinding operation the sharp working face or active rim 12 of the grinding wheel 10 and the outer surface or face 16 thereof are arranged in defined or predetermined planes 12E and 16E, respectively. In the case of wear of the working face or surface 12 of the grinding wheel 10 during the grinding operation, such working face 12 is displaced somewhat towards the left of the showing of the drawing. By performing corresponding axial adjustment or advance of the grinding wheel 10 the working face or surface 12 is again returned into the defined plane 12E. With increasing wear and dressing of the grinding wheel 10 the thickness of the material at the working face 12 decreases, so that after a period of time the outer surface or face 16 of the grinding wheel 10 also has to be dressed. Therefore, the grinding wheel 10 is relocated in the plane 16E by radial adjustment or advance thereof. A displacement measuring system 18 is operatively coupled to the grinding spindle, so as to enable precise measurement of the amount of displacement or advance of the grinding wheel 10 in axial as well as in radial direction.

A cross-slide or cross-slide system designated in its entirety by reference numeral 20 is located adjacent to the grinding wheel 10 at the level of the working face or surface 12 thereof. The cross-slide system 20 has a first slide $S_1$ which is displaceable essentially parallel to the working face or surface 12 and a second slide $S_2$ which is displaceable essentially at right angles or normally with respect to such working face 12. Infinitely adjustable drive means $M_1$ and $M_2$ are operatively associated with the slides $S_1$ and $S_2$, respectively. As shown, the infinitely adjustable drive means $M_1$ and $M_2$ may each comprise, for example, a suitable drive motor for driving the associated slide $S_1$ or $S_2$, respectively, by means of a not particularly referenced related spindle in both longitudinal directions thereof. The second slide $S_2$ carries a dressing tool 22 which usually will be a diamond. The dressing tool 22 is displaceable in parallel and normally with respect to the working face or surface 12 of the grinding wheel 10 by means of the first and second slides $S_1$ and $S_2$, respectively. The displacement accomplished by the first slide $S_1$ constitutes the dressing motion or movement by means of which part of the working face or surface 12 is removed by the dressing tool 22. The displacement accomplished by the second slide $S_2$ serves to adjust the dressing tool 22 in the direction of the working face 12 due to wear of such working face 12 and/or the dressing tool 22. A contact detector 24 is operatively associated with the second slide $S_2$ by means of which contact of the tip of the dressing tool 22 at the working face or surface 12 can be exactly determined.

A sensing or feeler device, generally designated in its entirety by reference numeral 26, serves to detect or sense the location of the working face 12 of the grinding wheel 10 in the defined plane 12E. This sensing device 26 contains a sensor or feeler 261 which is designed as a double-arm lever pivotable about a fulcrum or hinge 262; one end 263 of the sensor 261 confronts the working face 12. When the confronting end 263 contacts the working face 12, contacts 264 formed at the other end of the sensor 261 contact one another and supply a suitable signal via a signalling circuit 28 to control means 30 where the signal indicates that the working face 12 is located in the defined plane 12E. Furthermore, the contact detector 24 which indicates contact between the tip of the dressing tool 22 and the working face or surface 12, and the displacement measuring system 18 signalling the amount of adjustment or advance of the grinding wheel 10, in the illustrated example in axial direction thereof, are operatively connected to the control means 30. By means of power amplifiers $V_1$ and $V_2$ the control means 30 controls the drive means $M_1$ and $M_2$, respectively, of the cross-slide system 20.

The mode of operation of the apparatus described hereinbefore will now be explained in detail hereinafter.

A dressing operation is started by displacing the dressing tool 22 using the second slide $S_2$ driven by the drive means $M_2$ via the control means 30 horizontally away from the working face or surface 12, i.e. to the right in the showing of the drawing. By means of the conventional axially adjusting drive means the grinding wheel 10 is displaced towards the right to such an extent that it is located in the defined or predetermined plane 12E. This is detected by the sensing or feeler device 26. By means of the signal supplied by the signalling circuit 28 the control means 30 switches-off the axially adjusting drive means of the grinding wheel 10 by means of a suitable connection.

The control means 30, then, operates the drive means $M_1$ of the first slide $S_1$ such that the tip of the dressing tool 22 is displaced to the level of the center of the working face or surface 12 of the grinding wheel 10. Subsequently, the control means 30 again operates the drive means $M_2$, so that the second slide $S_2$ is displaced in a direction towards the working face 12 until there is a response from the contact detector 24 and the control means 30 then switches-off the drive means $M_2$ by means of the output signal delivered by the contact detector 24. The tip of the dressing tool 22 is now located exactly in the defined plane 12E.

Now the drive means $M_1$ is again placed into operation by the control means 30 and the first slide $S_1$ is displaced upwardly, as seen in the drawing, until an end position EL of the dressing tool 22 is reached. Then the drive means $M_2$ is operated by the control means 30 in order to adjust the dressing tool 22 by a desired dressing amount a whereby the dressing tool 22 is transferred from the end position EL to the new position EL'.

The working face or surface 12 of the grinding wheel 10 is then dressed by the dressing tool 12 by periodically reversing the operation of the drive means $M_1$, i.e. by reciprocating the first slide $S_1$.

Subsequently, the axially adjusting drive means for the grinding wheel 10 is operated anew, as described above. When the working face or surface 12 of the grinding wheel 10 is again positioned in the defined plane 12E, which will be recognized or detected by the sensing device 26, the axially adjusting drive means is switched-off by means of the signalling circuit 28 and the control means 30. The displacement measuring system 18 measures the amount of the advance or adjustment z thus performed and signals the same to the control means 30. A comparator 40 contained in the control means 30 compares the desired amount of dressing a with the amount of adjustment z of the grinding wheel 10. In case that the two amounts coincide with one another, then the working face 12 has been sufficiently dressed, i.e. has been sufficiently sharpened, and the grinding operation may start.

If, however, the comparator 40 detects or determines that the amount of adjustment z is smaller than the desired amount of dressing a this then means that the working face or surface 12 has not been sufficiently dressed because of wear existent in the dressing tool 22. Prior to starting the following grinding operation, therefore, the dressing tool 22 is again moved into the end position EL as described above and is adjusted by an additional dressing amount, the magnitude of which is selected in correspondence to the difference detected between the desired amount of dressing a and the amount of advance or adjustment z of the grinding wheel 10. Then the dressing operation is repeated. Consequently, the wear of the dressing tool 22 is compensated. The grinding operation may then be immediately started.

Also, the differences between the desired amount of dressing a and the amount of advance or adjustment z of the grinding wheel 10 detected during a number of dressing operations may, for example, be averaged or meaned, so that during later dressing operations the desired amount of dressing a may be modified right from the start in accordance with the degree of wear of the dressing tool 22. It thus will be possible to achieve much sooner coincidence or conformity between the desired amount of dressing a and the amount of advance or adjustment z, whereby the dressing operation may be substantially accelerated.

An apparatus of the same kind and generally designated by reference character 32 is shown in the drawing in broken or phantom lines. This apparatus 32 which also is operatively coupled to the displacement measuring system 18 and otherwise contains the same components as the apparatus described hereinbefore. This apparatus 32 serves the purpose of dressing the outer surface or face 16 of the grinding wheel 10 and to likewise compensate for the wear of the dressing tool during that dressing operation. In correspondence to the working face or surface 12 of the grinding wheel 10 which is maintained in the defined plane 12E, the outer surface or face 16 of the grinding wheel 10 is similarly held in the defined plane 16E. Otherwise the mode of operation of the apparatus 32 is completely analogous to that of the apparatus described hereinbefore.

While there are shown and described present preferred embodiments of the invention, it is to be distinctly understood that the invention is not limited thereto, but may be otherwise variously embodied and practiced within the scope of the following claims.

Accordingly, what I claim is:

1. A method for compensating for wear of an adjustable dressing tool containing a dressing tool tip for dressing a working face of an adjustable grinding wheel, comprising the steps of:

(a) defining a predetermined plane;

(b) positioning said grinding wheel with said working face essentially extending in said predetermined plane;

(c) positioning said tip of said dressing tool in an end position displaced from said working face but within said predetermined plane;

(d) adjustably advancing said dressing tool by a desired dressing amount;

(e) dressing said working face of said grinding wheel;

(f) adjusting the position of said grinding wheel in order to position said working face thereof in said predetermined plane;

(g) measuring the amount of the adjustment of said grinding wheel needed in order to position said working face thereof in said predetermined plane;

(h) comparing the measured amount of said adjustment of said grinding wheel undertaken in step (g) with said desired dressing amount of step (d) and thereby determining a difference between the grinding wheel adjustment of step (f) and the desired dressing amount of step (d); and (i) immediately after step (h) repeating steps (b) to (h) but with an adjustable advance of the dressing tool during step (d) wherein the desired dressing amount is increased by the difference determined during step (h).

2. The method as defined in claim 1, wherein steps (b) and (c) thereof further entail the sub-steps of:

removing said dressing tool from said working face of said grinding wheel;

displacing said dressing tool to a position approximately aligned with a central region of said working face of said grinding wheel;

displacing said dressing tool in a first direction so that said tip thereof contacts said working face of said grinding wheel; and then displacing said tip in a second direction extending essentially normally relative to said first direction in order to position said tip in an end position displaced from said working face but within said predetermined plane.

3. A method of dressing a working face of an adjustable grinding wheel by means of an adjustable dressing tool, comprising the steps of:

(a) defining a predetermined plane;

(b) positioning by using continuously adjustable positioning means said grinding wheel with said working face essentially extending in said predetermined plane;

(c) positioning a tip of said dressing tool in an end position displaced from said working face but within said predetermined plane;

(d) adjustably advancing by using continuously adjustable advancing means said dressing tool by a desired dressing amount;

(e) dressing said working face of said grinding wheel;

(f) repositioning said grinding wheel after said dressing operation in order to position said working face thereof in said predetermined plane;

(g) continuously measuring by said continuously adjustable positioning means the amount of the adjustment of said grinding wheel needed in order to reposition said working face thereof in said predetermined plane;

(h) comparing the continuously measured amount of said repositioning adjustment of said grinding wheel undertaken in step (g) with said desired dressing amount of step (d) and thereby determining a difference between the grinding wheel repositioning adjustment and the desired dressing amount; and (i) immediately after step (h) repeating steps (b) to (h) but with an adjustable advance of the dressing tool during step (d) wherein the desired dressing amount is the difference determined during step (h).

4. A method of dressing an adjustable grinding wheel by means of an adjustable dressing tool containing a dressing tool tip for dressing a working face of such adjustable grinding wheel and for compensating, when necessary, for a predetermined amount of wear of the adjustable dressing tool during such dressing operation, comprising the steps of:

(a) defining a predetermined plane;

(b) positioning said grinding wheel with said working face essentially extending in said predetermined plane;

(c) positioning said tip of said dressing tool in an end position displaced from said working face but within said predetermined plane;

(d) adjustably advancing said dressing tool by a desired dressing amount;

(e) dressing said working face of said grinding wheel;

(f) adjusting the position of said grinding wheel in order to position said working face thereof in said predetermined plane;

(g) measuring the amount of the adjustment of said grinding wheel needed in order to position said working face thereof in said predetermined plane;

(h) comparing the measured amount of said adjustment of said grinding wheel undertaken in step (g) with said desired dressing amount of step (d) to determine if a difference exists between said two amounts;

(i) if a difference is determined during step (h) which is greater than the predetermined amount of wear of the dressing tool which should be compensated repeating steps (b) to (h) but with an adjustable advance of the dressing tool during step (d) wherdin the desired dressing amount of step (d) now amounts to the difference determined during step (h); and (j) if the difference determined during step (h) is less than the predetermined amount of wear of the dressing tool which should be compensated stopping the dressing operation.

* * * * *